United States Patent [19]

Markey

[11] Patent Number: 4,750,402

[45] Date of Patent: Jun. 14, 1988

[54] FOLDING TABLE COVER FOR HANDBELLS

[75] Inventor: Willard H. Markey, E. Rockhill Township, Bucks County, Pa.

[73] Assignee: Malmark, Inc., Plumsteadville, Pa.

[21] Appl. No.: 26,069

[22] Filed: Mar. 16, 1987

[51] Int. Cl.[4] ..... G10G 5/00

[52] U.S. Cl. ..... 84/453; 84/406; 108/90; 150/52 R

[58] Field of Search ..... 84/406, 421, 453; 108/90; 150/52 R

[56] References Cited

U.S. PATENT DOCUMENTS 2,728,165 12/1955 Runyon ..... 150/52 R
4,337,812 7/1982 Trinkner ..... 150/52 R X
4,708,183 11/1987 Figueroa ..... 150/52 R

*Primary Examiner*—Lawrence R. Franklin
*Attorney, Agent, or Firm*—Gregory J. Gore

[57] ABSTRACT

A collapsible table cover assembly for use in the handbell performing arts also serves as a convenient carrying case for implements used in playing handbells. The collapsible nature of the cover also makes the article more compact for convenient transportation. A rear pocket portion is attached to an outer cover so that playing implements may be conveniently at hand during a handbell performance. Specially selected foam padding is employed to enhance the musical quality of the table cover. A releaseably detachable apron provides aesthetic appeal while contributing to the assembly's portability.

6 Claims, 4 Drawing Sheets

FOLDING TABLE COVER FOR HANDBELLS

FIELD OF THE INVENTION

This apparatus relates to the field of musical instruments and instrumental performance. More specifically, this invention relates to the playing of handbells.

BACKGROUND OF THE INVENTION

Percussion instruments, such as handbells, often require additional implements to supplement the playing of the instrument in order to achieve a wider variety of musical sounds. Handbells, in particular, may require the use of different types of mallets for playing the instruments. In addition, there are other non-playing accessories which are often used in a handbell performance which include: special gloves, polishing cloths, sheet music, etc. Another part of the necessary handbell apparatus is the handbell table which not only serves as a convenient resting place for the instruments, but as further described herein also becomes an active part of the musical apparatus which is used to affect the tone and sound of the handbells.

There is a need in the handbell performing arts for an apparatus which enables musicians to easily transport and set up all of the above described handbell-playing apparatus and structures. Furthermore, there is a need for a table cover constructed from the correct materials in order to enhance the musical qualities of the handbells.

SUMMARY OF THE INVENTION

In order to fulfill the above-mentioned needs, the present invention includes a folding table cover which also serves as a convenient carrying or storage case for handbell accessories. In its unfolded, playing condition, the apparatus serves as an attractive and functional table cover. It further serves as sound damping pad for muting the instruments. The cover includes pockets in a vertical rear portion for holding various implements such as sheet music, polishing cloths, gloves and mallets. The playing aspects of the table cover are enhanced by a specific thickness and type of foam padding.

The apparatus is also designed to be convenient for collapsing to a folded condition whereby the dimensions of the table cover are reduced for more convenient transportation. When folded, a central containment area is created which can house the various handbell playing implements and accessories. In addition, the above-mentioned central containment area is designed to fall between two foam padded side sections to protect the implements during transportation. A handle and securing strips are included for the convenience of the carrier.

DESCRIPTION OF THE PREFERRED EMBODIMENT

Figure 1:
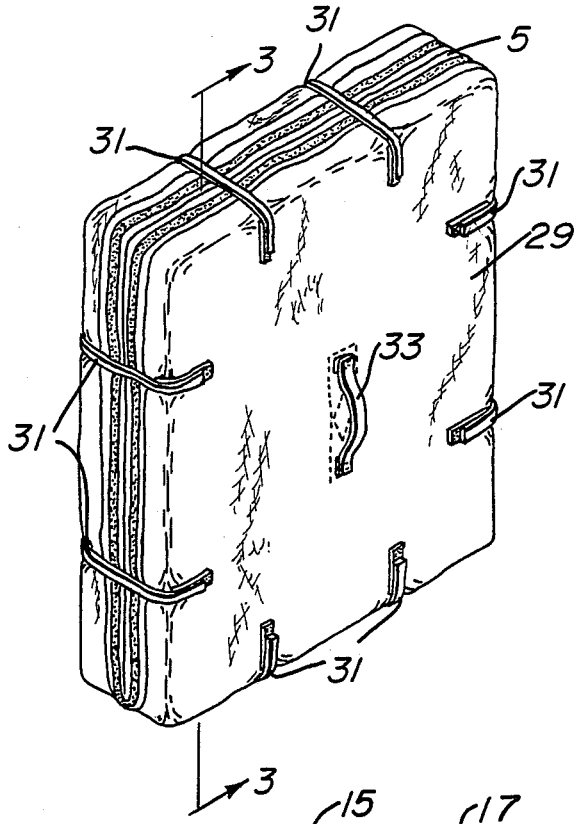
FIG. 1 shows the table cover in its folded condition.
Figure 4:
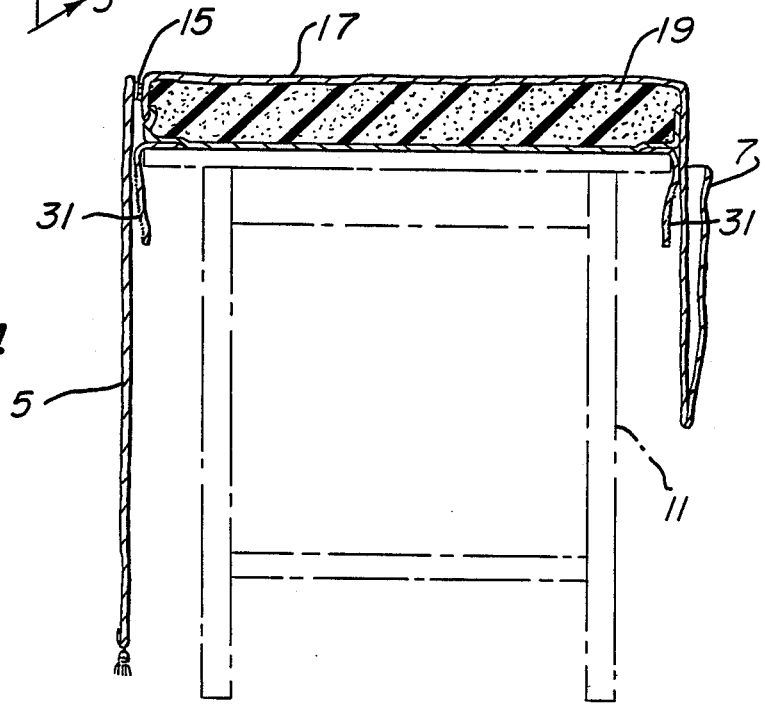
FIG. 4 shows a sectional view taken from FIG. 2 which more clearly shows the interrelationship elements of the table cover.
Figure 2:
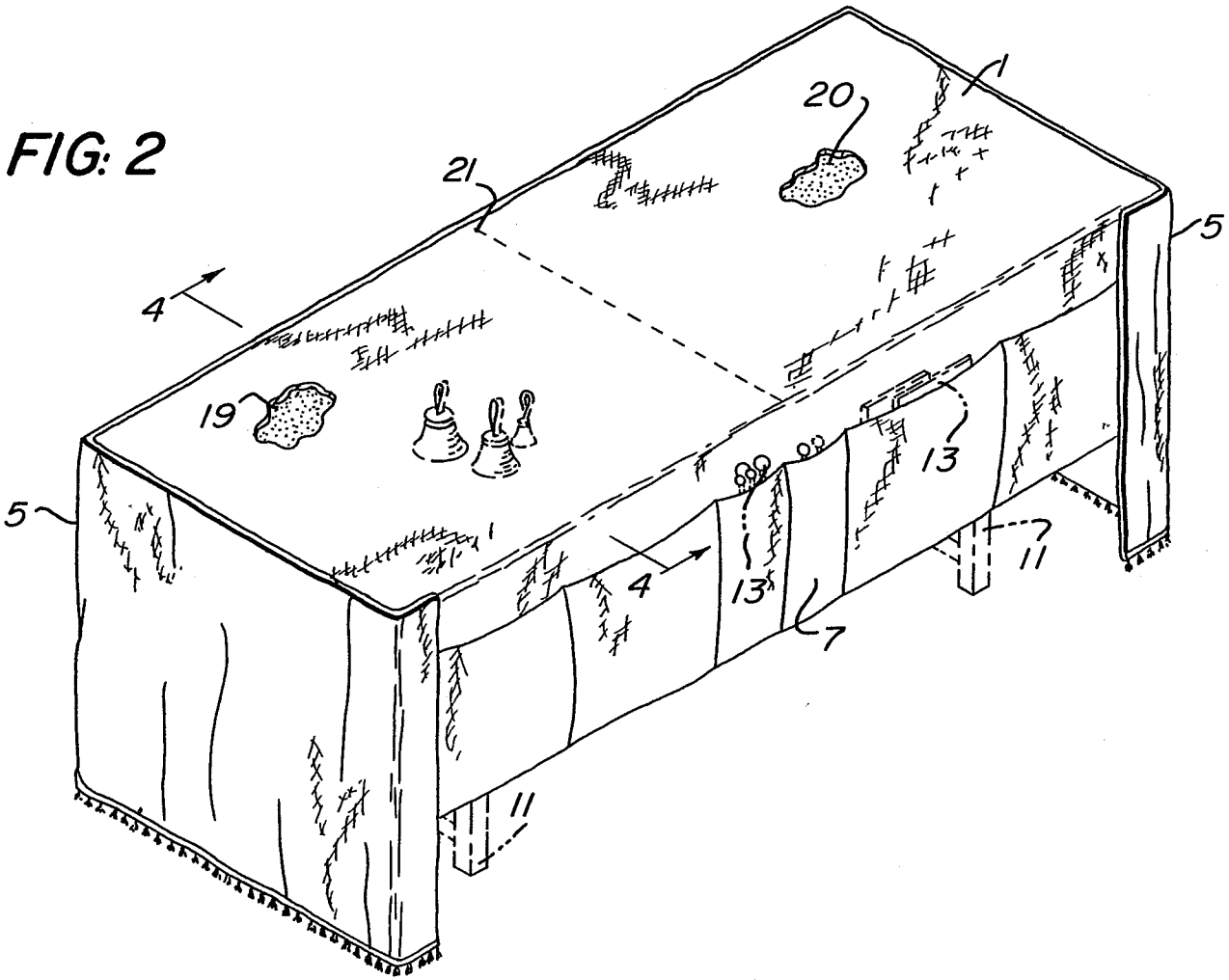
FIG. 2 shows the table cover in its unfolded or playing condition.
Figure 3:
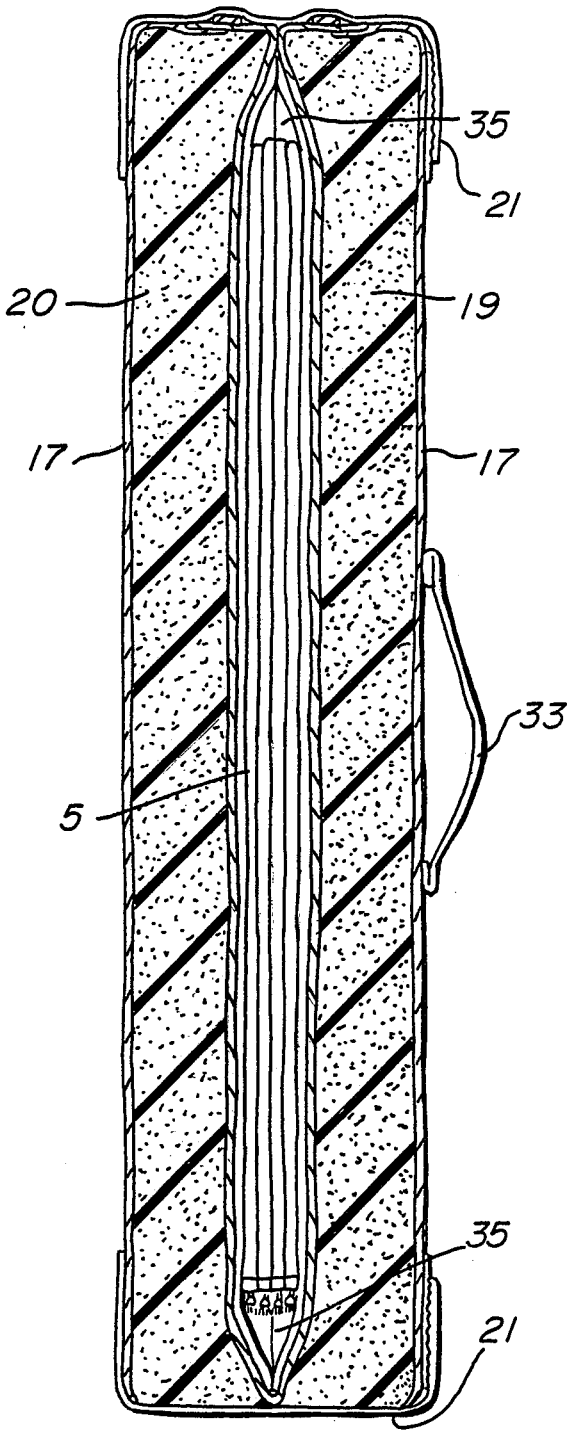
FIG. 3 shows a sectional view taken from FIG. 1 showing the location of the central containment area.

Referring now to FIG. 2, the table cover unit 1 is shown in its unfolded horizontal playing condition. The cover is placed on top of table 11 which may be an table of desirable size and height. During a performance, the handbell ringer stands behind table 11 facing rear pocket portion 7 which holds items such as mallets, polishing cloths, sheet music, etc., indicated by numeral 13. The table is draped on four sides by vertical apron 5 which extends from the top of the outer cover down to the floor. Apron 5 is made conveniently detachable from the table top cover 1 by the use of Velcro® pieces 15 as more clearly shown in FIG. 4. Table top cover unit 1 includes an outer covering 17 and internal padding sections 19 and 20 made of foam. Referring to FIG. 3, it can be seen that the foam padding is divided into two equal sections. In FIG. 2, this is represented by dotted line 21. The sectioning of the foam padding aids in folding of the table cover to result in the compacted article shown in FIG. 1.

The table cover of the present invention as shown in FIG. 2 may be converted to a carrying case according to the following steps. First, apron 5 is detached from around the periphery of the table cover by virtue of releaseable Velcro® strips 15. Apron 5 may then be folded in a conventional fashion and placed to one side on top of the horizontal table cover. Next, the rear pocket portion 7 containing various handbell implements and accessories is lifted forward and up so that the implements and accessories are held between the top surface of the table cover and the back of the rear pocket portion. Then, the two ends of the top cover are lifted upward and held together. Next, securing strips 31 having Velcro® attachment means are applied around the sides of the folded article as shown in FIG. 1. The flat outer faces, such as face portion 29, is located against the table top when in the unfolded or playing conditions so that Velcro® attachment pieces 31 are hidden from view and do not interfere with the playing surface. Permanently attached handle 33 provides a convenient grip point for the carrier during transport.

When in its folded condition for transportation or storage, the table cover serves as a convenient case for unifying and organizing the various handbell accessories. Referring now to FIG. 3, foam portions 19 and 20 surround central containment area 35 which is created when the table cover is folded. As explained above, this area carries the detachable folded apron 5 as well as permanently attached pocket portion 7. For convenient carrying of the various playing implements and accessories, these accessories may remain in the pocket portion which then become located in the central containment area 35 when the table cover is folded. Oriented in this way, foam padding units 18 and 19 serve as a convenient outer protection for these accessories.

Figure 5:
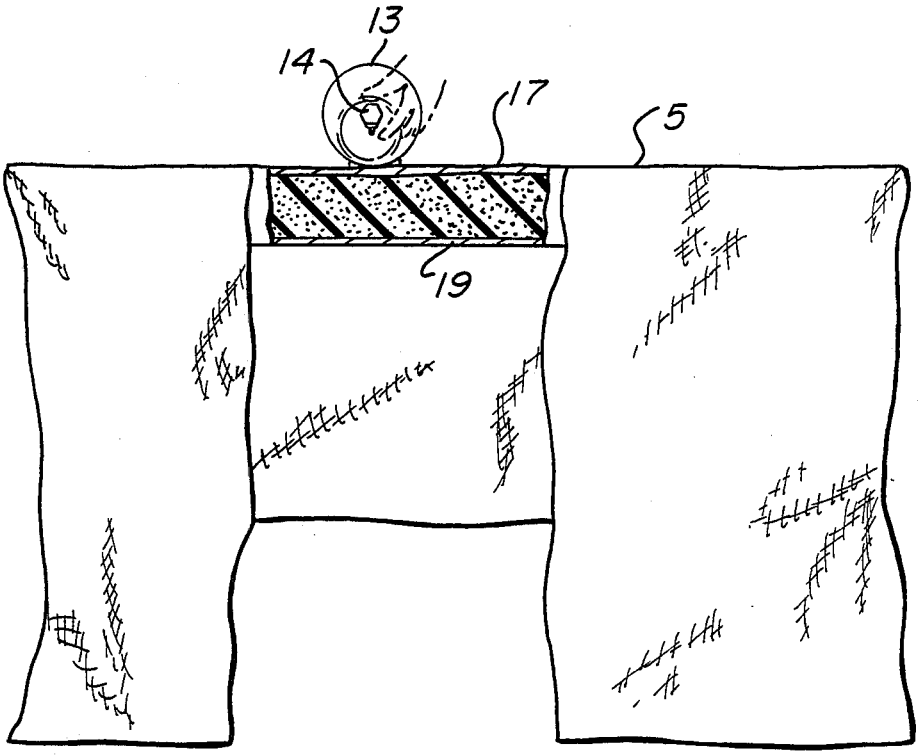
FIG. 5 shows the padded table cover being used to modify a musical tone.

Referring now to FIG. 5, handbells 13 are often played with a technique called "plucking". This playing technique is executed by laying a bell down on top of the table cover and, lightly holding the handle with one hand, the clapper 14 is grasped between the thumb and first two fingers of the other hand. Now, the clapper is flipped downward with a quick snap. With this type of playing, table cover surface 17 becomes an active part of the musical instrument resulting in a dramatic sound which is the combination of a percussive sound with tonal resonance.

It is important for the creation of the proper plucked sound that the outer covering 17 have the correct texture and density. Furthermore, the weight and depth of padding sections 19 and 20 must be properly selected. The present invention employs a thick pin wale corduroy fabric for the outer cover made from 83% cotton and 17% polyester. The foam padding should be between 3–5 inches thick. The foam density should be between 10–50 ILD (internal load density) with a volumetric density between 1.00–1.75 pounds per cubic foot. The preferred embodiment employs ether-type polyurethane foam. These dimensions and types of materials have been found to yield optimal results.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A folding handbell table cover, comprising:

(a) foam-padding for covering a table top in its unfolded condition, said foam padding divided into two equal and separate sections to facilitate folding, (b) an outer cover completely enclosing said foam padding, and (c) a pocket portion permanently affixed to said outer cover for holding playing implements and other accessories.

2. The handbell table cover of claim 1 further including an apron portion releaseably attached to said outer cover.

3. The handbell table cover of claim 2 further including a central containment compartment when folded, said pocket portion lying completely within said compartment.

4. The table cover of claim 3 further including a carrying handle affixed to the underside of said table cover.

5. The handbell table cover of claim 4 further including a plurality of detachable securing means for maintaining said table cover in a collapsed or folded condition.

6. The handbell table cover of claim 5 further described in that said foam is between 3 and 5 inches thick and has a volumetric density between 1.00 and 1.75 pounds per cubic foot.

* * * * *